US005547797A

United States Patent [19]

Anno et al.

[11] Patent Number: 5,547,797

[45] Date of Patent: Aug. 20, 1996

[54] DEVELOPER FOR DEVELOPING ELECTROSTATIC LATENT IMAGES

[75] Inventors: Masahiro Anno, Sakai; Minoru Nakamura, Neyagawa; Makoto Kobayashi, Settsu; Shigeyuki Hakumoto, Toyonaka, all of Japan

[73] Assignee: Minolta Co., Ltd., Osaka, Japan

[21] Appl. No.: 284,236

[22] Filed: Aug. 2, 1994

[30] Foreign Application Priority Data

Aug. 5, 1993 [JP] Japan ..... 05-194659
Aug. 5, 1993 [JP] Japan ..... 05-194663

[51] Int. Cl.[6] ..... G03G 9/083; G03G 9/08

[52] U.S. Cl. ..... 430/106.6; 430/110; 430/111

[58] Field of Search ..... 430/106.6, 110, 430/111

[56] References Cited

U.S. PATENT DOCUMENTS

| | | | |
|---|---|---|---|
| 4,482,621 | 11/1984 | Kashiwagi | 430/111 X |
| 5,305,061 | 4/1994 | Takama et al. | 430/111 X |
| 5,328,792 | 7/1994 | Shigemori et al. | 430/111 X |

FOREIGN PATENT DOCUMENTS

| | | | |
|---|---|---|---|
| 54-121130 | 9/1979 | Japan . | |
| 55-28020 | 2/1980 | Japan . | |
| 57-201242 | 12/1982 | Japan . | |
| 58-70237 | 4/1983 | Japan . | |
| 123857 | 7/1985 | Japan | 430/111 |
| 185653 | 7/1989 | Japan | 430/111 |

*Primary Examiner*—Roland Martin
*Attorney, Agent, or Firm*—Burns, Doane, Swecker & Mathis, L.L.P.

[57] ABSTRACT

The present invention provides a developer for developing electrostatic latent images comprising:

a spherical toner whose number average particle size is 2–10 μm and which at least contains a binder resin and a colorant, and a nonspherical toner which comprises practically same composition as that of the spherical toner, has a number average particle size of 2–10 μm, and has the number average particle size within ±25% of that of the spherical toner, the spherical toner whose ratio to the total number of toner being 5–80%.

The developer the present invention is excellent in fluidity, blade cleaning properties, environmental stability, and charge stability.

17 Claims, 3 Drawing Sheets a: rotating direction of magnetic roll b: moving direction of developer

DEVELOPER FOR DEVELOPING ELECTROSTATIC LATENT IMAGES

BACKGROUND OF THE INVENTION

1. Field of the Invention

This invention relates to a developer for developing electrostatic latent images, which is used for electrophotography.

2. Description of the Prior Art

In recent years, much higher image quality is required in the fields of electrophotographic copying machines and printers. To satisfy this requirement, various efforts have been made to the toner particle size small.

However, making the toner particle size small causes the specific surface area of the toner to increase, resulting in poor fluidity of the toner. From the viewpoint of improvement of fluidity, it is effective to spheroidize the toner to minimize the specific surface area of the toner.

The spherical toner is, in general, manufactured by a wet granulation method. Almost all the toner particles obtained by this method are spherical. Consequently, in the blade cleaning process, toner particles are likely to pass through the blade, frequently causing cleaning failure.

On the other hand, cleaning failure can be prevented by making the toner shape nonspherical with respect to the toner form. Nonspherical toners are, in general, manufactured by a kneading-pulverizing method. The toners manufactured in this way are almost all nonspherical and have large specific surface area, causing poor fluidity. The fluidity of nonspherical toners can be improved, for example, by increasing the addition of fluidizing agents such as silica, but in such a case, problems of degraded environmental-resistance, generation of low-charged toners and fogging associated with it, and the similar problems occur.

The effects of the toner shape on toner properties as described above are more serious in a one-component developing method. In the one-component developing method, the toner is fed to surface of a toner supporting member and is rubbed and charged electrically while a toner thin layer is being formed on the supporting member by a regulating member of toner layer thickness. The electrostatic latent image is developed by the thin layer of the toner on the supporting member.

The one-component developing method as described above depends on a form of the regulating member of toner layer thickness and a regulated pressure. That is, if the toner primarily consists of spherical particles, the toner fluidity increases but on the contrary, it becomes difficult to regulate the toner in the thin layer state by the regulating member because toner particles pass through the regulating member. To prevent this problem, it is necessary to increase the regulating pressure, but this will cause sticking and fusion of the toner components on the regulating member and sleeve surface.

On the other hand, for the nonspherical toner, toner fluidity is degraded. Therefore, increasing regulation of the toner prevents the toner from being transported on the sleeve through the clearance between the sleeve and the regulating member. This needs to relaxing the regulating pressure, but this will lose a chance for the toner to come in sufficient contact with the sleeve and/or the regulating member, and the toner is unable to be thoroughly charged. As a result, image noises such as fogging and the like as well as machine contamination occur due to generation of low-charged toners and reversely charged toners by frictional electrification between toners.

SUMMARY OF THE INVENTION

The object of the present invention is to provide a developer which contains small particle-size spherical toners and non-spherical toners at a specified rate and has excellent chargeability, environmental-resistance, and cleaning properties.

The present invention relates to a developer for developing electrostatic latent images comprising:

a spherical toner whose number average particle size is 2–10 μm and which at least contains a binder resin and a colorant, and a nonspherical toner which comprises practically same composition as that of the spherical toner, has a number average particle size of 2–10 μm, and has the number average particle size within ±25% of that of the spherical toner, the spherical toner whose ratio to the total number of toner being 5–80%.

DETAILED DESCRIPTION OF THE INVENTION

Figure 1:
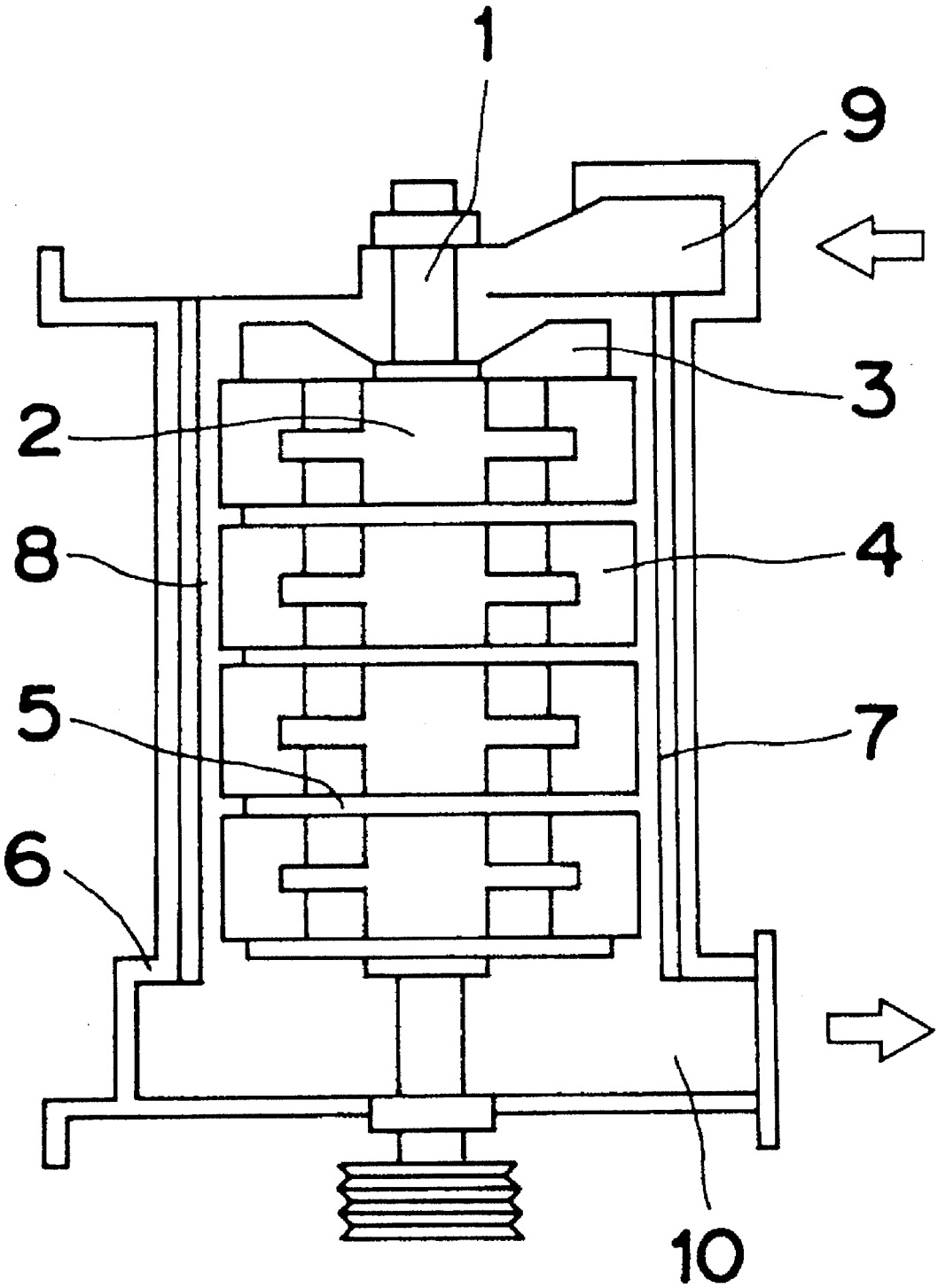
FIG. 1 is a schematic block diagram of a pulverizing machine.

A developer of the present invention comprises at least spherical toners and non-spherical toners which are composed of the compositions practically same as those of the spherical toners.

In the present invention, the spherical toner can be defined as follows by the shape factor (SF). That is, the spherical toner has the toner having 100–140 SF values when the shape factor is given by the following expression (Eq. 1):

$$SF - \frac{(\text{Maximum length})^2}{\text{Area}} \times \frac{\pi}{4} \times 100$$

in which the area means a projected area of particle and the maximum length means a maximum length in a projected image of particle.

SF expresses the difference in length between the major axis and the minor axis of the toner (strain characteristics) and the value of SF is 100 when the toner is completely spherical.

The shape factor is used as a coefficient for expressing a form, such as a powder shape and is analyzed by an image analyzer (commercially available from Nihon Regulator Co. as LUZEX 5000). Specifically, using a scanning type electron photomicrograph, the surface image of the toner particles is memorized in the image analyzer and the SF values are calculated. However, since the measured value of shape factor SF has no significant difference between machine types, this does not mean that the shape factor must be measured with the machine type mentioned above.

The spherical toner of the present invention shall be adjusted to the range of 2–10 μm, preferably 3–8 μm in terms of the number average particle size (hereinafter called "average particle size"). If the average particle size is greater than 10 μm, the object to achieve high quality of the duplicated image is not met. The toner whose particle size is smaller than 2 μm is difficult to manufacture and has a problem of difficult handling at each element (toner replenishing, development, transfer, fixation, cleaning) of the image forming equipment.

The number average particle size of the present invention is obtained by measuring the particle size of arbitrally selected 100 pieces of toner particles on electron photomicrographs. For the particle size of non-spherical toners, a mean value of major and minor axes is designated as the particle size.

It is more preferable that particles have particle size distribution such that the number of particles with particle size ½ or smaller the number average particle size is less than 5%, preferably 3% or less and that the number of particles with particle size greater than double the mean particle size is 1% or less, preferably 0.5% or less. Thereby, the above problems can be more effectively solved. Further image stability is also improved when used repeatedly.

The small particle-size spherical toners as described above can be, in general, manufactured: by a wet granulation method. Specifically, they can be obtained by a suspension method in which colorants and other desired additives are dispersed in a solution with binding resin dissolved and this dispersed solution is dispersed and spheroidized in a solvent not compatible with the solution and suspended, and spherical toners of small particle size are obtained by removing the solvent from this dispersed suspension; or by a suspension polymerization method in which a monomer solution with colorants and other desired additives dispersed therein is dispersed, spheroidized and suspended in a solvent not compatible with the monomer solution and spherical toners of small particle size are obtained by polymerizing the monomer under the suspended condition; or by emulsion polymerization in which monomer is polymerized in micelle. In the case of emulsion polymerization, good particle size distribution can be achieved and extremely fine particles can be produced. Therefore, it is desirable to use a method known as seed a polymerization method. That is, part of polymerizable monomer and polymerization initiator are added to an aqueous medium or an aqueous medium containing an emulsifier, agitated and emulsified, and thereafter, the remainder of the polymerizable monomer is gradually added to have fine particles, and using these particles as seeds, polymerization is carried out in the monomer liquid drops containing colorants and other additives.

Other examples of wet granulation method involving polymerization process include soap-free emulsion polymerization method, microcapsule method (interfacial polymerization method, in-situ polymerization method, etc.), nonaqueous dispersion polymerization, and the like. In addition, the small particle-size spherical toners can be manufactured by a spray-dry method and by spheroidization via heat treatment or mechanical impact provided for non-spherical toners.

The non-spherical toners used together with the spherical toners are explained hereinafter. In the present invention, non-spherical toners mean the toners whose shape factor SF is greater than 140.

The non-spherical toners consist of the compositions practically same as those of the spherical toners. In the present invention, the practically same compositions include not only the case when the toners have the literally same compositions but also the case when both toners possess physical identity. They also include the case when a binder resin, a colorant, and a charge controlling agent and a post-treatment agent which are added as required slightly differ in addition quantities.

Non-spherical toners shall be adjusted to the range of 2–10 μm, preferably 3–8 μm, in terms of number average particle size.

In addition, the average particle size of non-spherical toners shall be adjusted to within ±25%, preferably within ±20%, more preferably within ±18%, with respect to the average particle size of spherical toners. The use of non-spherical toners adjusted outside the range with spherical toners mixed will generate trouble in cleaning properties or fluidity. The ratio of consumption of spherical toners to non-spherical toners differs, making it difficult to maintain the mixture ratio of spherical toners to non-spherical toners.

Non-spherical toners can be manufactured by melting, mixing, and pulverizing a binding resin, a colorant and other desired additives. In particular, it is desirable to use non-spherical toners pulverized by a jet pulverizer. Non-spherical toners may be obtained by grinding or deforming spherical particles by either wet or dry process using a beads mill. It is also possible to use non-spherical particles which are produced by coagulating spherical particles by heating, etc. and grinding this coagulated particles by either wet or dry process.

In the present invention, spherical toners are contained at a ratio of 5–80%, preferably 10–70%, more preferably 20–60% with respect to the total number of toner particles. Conventional problems cannot be solved if the quantity of spherical toners is excessively large or excessively small. The ratio means a ratio (%) of the number of spherical toners with respect to the SF value when 100 pieces of particles are measured by the image analyzer (commercially available from Nihon Regulator Co. as Luzex 5000).

The spherical toner particles and non-spherical toner particles may be mixed so that the ratio of 5 to 80% may be given. When the wet granulation method is used, the ratio of spherical toners can be adjusted depending on toner production conditions, such as aggregation, drying and pulverization. Such a method is explained hereinafter. After granulating the toner particles (hereinafter called "toner base particles") in the liquid medium, toner base particles are preferably added with water-insoluble organic or inorganic fine particles to the toner base particle obtained. Adding this kind of particles enables stable production of agglomerates of a desirable size and stable fusing operation. Furthermore, pulverizing properties thereafter will be remarkably improved. Needless to say, properties which organic or inorganic particles possess are imparted to final toner particles.

Examples of organic or inorganic particles in this case include charge controlling agents, fluidizing agents, magnetic particles, offset-preventing agents, cleaning assistants, which may exhibit single or multiple functions (however, in this invention, when these additives are mixed in the toner base particle, it is not always necessary to allow all these types of additives to adhere and exist on the toner base particle surface as the above-mentioned fine particles but they may be able to blend some of them together with binding resin and colorants and incorporate them in the toner base particle, and furthermore, it is possible to enable the additives of the same type not only to be incorporated in the toner base particle but also to adhere and exist on the toner base particle surface as fine particles).

Examples of magnetic substance to be added in preparing the magnetic toner include magnetite, y-hematite, or various ferrite, and the like.

For offset-preventing agent to be used for improving the toner adhesion, specifically various waxes, in particular, low-molecular-weight polypropylene, polyethylene, or polyolefin-based waxes such as oxide-type polypropylene, polyethylene, etc., and in addition, natural waxes such as carnauba wax, etc. are suitably used.

For fluidizing agents, various metal oxides such as silica, aluminum oxide, titanium oxide, magnesium fluoride, and the like are used independently or in combination.

Examples of cleaning assistants include inorganic fine particles discussed above as fluidizing agents, metallic soaps such as stearate, and fine particles formed of various synthetic resin such as fluorine type, silicon type, styrene-(meta)acrylic type, benzoguanamines, melamines and epoxys.

Various types of organic or inorganic charge controlling agents can be used without limitation if they provide positive or negative charges by frictional electrification.

For organic or inorganic fine particles which are used in the present invention, it is not limited to those specified above but at least in addition to these, examples of organic fine particles include various fine organic particles, such as styrene resins, (meta)acrylic resins, olefinic resins, fluorine-containing resins, nitrogen-containing (meta)acrylic resins, silicon resins, benzoguanamine resins, and melamine resins, which are prepared by a wet-process polymerization such as emulsion polymerization, soap-free emulsion polymerization, and nonaqueous dispersion polymerization, and vapor phase polymerization. Examples of inorganic fine particles include various carbides such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carbon random, various nitrides such as boron nitride, titanium nitride and zirconium nitride, boride such as zirconium boride, various oxides such as iron oxide, chromium oxide, calcium oxide, magnesium oxide, zinc oxide, copper oxide, titanium oxide, alumina and colloidal silica, sulfides such as molybdenum disulfide, fluorides such as carbon fluoride, various metallic soaps such as aluminum stearate, calcium stearate, zinc stearate and magnesium stearate, and various nonmagnetic inorganic fine particles such as talc, and bentonite.

For organic or inorganic fine particles, it is desirable for them to be made hydrophobic or inherently hydrophobic from the viewpoint of moisture resistance or charge stability of toner particles obtained. In particular, it is desirable for them to have a 5 or higher hydrophobic index (MW: methanol wettability).

It is desirable that the size of organic or inorganic fine particles is ⅕ or smaller, more preferably, about 1/1000–1/10 compared with an average particle size of granulated toner base particle. That is, if the size of these organic or inorganic fine particles is larger than ⅕ the average particle size of toner base particle, it becomes impossible to allow the organic or inorganic fine particles to adhere to the toner particle surface with sufficient strength. The use of excessively small sizes will not produce the desired effects achieved by the addition of various fine particles.

The addition of these organic or inorganic fine particles depends on the functions, types, etc. of organic or inorganic fine particles used but is 0.01–20 parts by weight, preferably 0.01–10 parts by weight, and more preferably 0.1 to 5 parts by weight on the basis of 100 parts by weight of toner base particles. That is, if the addition of these organic or inorganic fine particles is less than 0.01 parts by weight, the amount of organic or inorganic fine particles adhering and existing on the toner base particle surface becomes insufficient, producing a possibility to prevent these from effectively functioning. On the other hand, if the addition exceeds 20 parts by weight, organic or inorganic fine particles which do not adhere to the toner base particle surface with sufficient strength even via the process to agglomerate toner base particle, resulting in a possibility to separate from the toner particle surface at the time of operation. In particular, when the organic or inorganic fine particles to be added are charge controlling agents, their addition should be preferably 0.01–5 parts by weight, more preferably 0.1–3 parts by weight on the basis of 100 parts by weight of the toner particles. When the organic or inorganic fine particles are fluidizing agents, the addition should be preferably 0.1–5 parts by weight, more preferably 0.3–3 parts by weight on the basis of 100 parts by weight of the toner particles.

Examples of a method for adding above fine particles include (a) a method to mix organic or inorganic fine particles with the base material in the wet process followed by agglomeration, (b) a method to agglomerate base material followed by addition of organic or inorganic fine particles to the agglomerate and then drying them, (c) a method to add and mix organic or inorganic fine particles after agglomerating and drying the base material to form block-like products, and then to pulverize the mixture.

For another example, it is possible to adopt a method to add organic or inorganic fine particles after drying wet agglomerates (powder-powder mixing).

The addition of the above-mentioned various organic and inorganic fine particles contributes to the shape control of toner particles. In the case of the above-mentioned method (a), when the addition is increased, the toner particle shape is controlled to be spherical. When the addition is decreased, the shape is controlled to be nonspherical. Conversely, in the case of methods (b) and (c), depending on the resin to be used, when the addition is increased, the toner particle shape is controlled to be nonspherical, while decreasing the addition controls it to be spherical.

After granulation of toner base particles, the particles are agglomerated. In the agglomeration process, known flocculants, for example, inorganic acid such as hydrochloric acid, organic acid such as oxalic acid, and water-soluble metallic salts formed of these acids and alkaline earth metal, aluminum and the like may be used. However, because these flocculants may have effects on the toner performance, special attention must be placed on their use.

For methods to agglomerate the toner base particles, several examples can be considered. In 1st example, prior to a drying process, a liquid medium in which toner base particles and desired organic or inorganic fine particles are dispersed is heat-treated (for example, at temperatures exceeding glass transition temperature (Tg) of resin contained in the toner base particles and at the same time below the boiling point of the liquid medium). In 2nd example, prior to a drying process, a solution containing a nonaqueous solvent which can dissolve or swell the resin is brought in contact with the toner base particles with the organic or inorganic fine particles adhered to its surface as required. In 3rd example, dried toner base particles with the organic or inorganic fine particles adhered to its surface as required are heat-treated (at a temperature exceeding glass transition temperature (Tg) of the resin contained in the toner base particles and below a softening temperature (Tm) +60° C.). In 4th example, dried toner base particles with the organic or inorganic fine particles adhered to its surface as required are brought in contact with a solution containing a nonaqueous solvent which can dissolve or swell the resin component contained in the toner base particles and then dried again. In 5th example, temperature and/or pressure in the drying process is set to a certain extent higher than those in the general drying conditions. In 6th example, in a drying process, a solution containing a nonaqueous solvent which can dissolve or swell the resin component contained in the toner base particles is brought in contact with the toner base particles. Needless to say, it is possible to combine some of the above-mentioned treatment methods.

In the above methods (1)–(6), storage of these toner base particles under high-humidity conditions after the drying process can achieve further suitable condensation property.

The size of agglomerated particles shall be adjusted to 10–500 μm, preferably 20–300 μm, more preferably 20–200 μm. The size greater than 500 μm will degrade pulverizability, while the size smaller than 10 μm makes it difficult to control the shape.

The agglomeration treatment as described above causes the surface portion of toner base particles to fuse, dissolve, or swell, joining the toner base particles one another. It is possible to change the ratio of quantity of spherical toner to nonspherical toner in a final developer by controlling this agglomerating state. The greater the degree of fusion, dissolution, or swelling, the greater the ratio of the nonspherical toner finally obtained if the subsequent pulverizing process is carried out under the same conditions. That is, raising treatment temperature and increasing treatment time facilitates generation of nonspherical toner particles. Specific treatment temperature and time shall be selected as required in accord with the treatment method.

For example, if condensation treatment is carried out by the 3rd method above, heat treatment is carried out preferably at a temperature between (glass transition temperature +5° C.) and (softening temperature −10° C.) of resin composing the toner base particles, more preferably at a temperature between (glass transition temperature +10° C.) and (softening temperature −20° C.) for treatment time of 5–120 minutes, preferably 10–90 minutes. In order to make the toner particle shape nonspherical, higher treatment temperature and longer treatment time shall be applied.

It is also effective for shape control to control pressure. For example, treatment under pressure is able to increase the ratio of nonspherical particles.

The binding force between toner base particles under the agglomerating state depends on the size of particle to some extent. As the particle size decreases, the binding force tends to increase. Consequently, even if the agglomerating state is such that the binding force in joining particles contained in the main particle size range (for example, the particle size ranges from around 2 to 8 μm) of the toner base particles formed in the wet type agglomeration is comparatively weak and the particles can be pulverized nearly from the joining portions by small external force, the binding force of super fine powders whose diameter is less than 1 μm to larger particles present in the above particle size ranges is sufficiently large, and applying external force as described above to them thereafter has little possibility to re-liberate these super fine powders.

In isolating or fractionating the toner base particles or agglomerate from the solution, it is possible to use a nonsolvent as precipitating agent. The nonsolvent means a solvent which does not dissolve or disperse resin of the toner base particles. Examples of these nonsolvents include hexene, heptane, octane, petroleum ether, and other hydrocarbons, methanol, ethanol, and other lower alcohols.

In the manufacturing method of the present invention, the toner base particles may be dried after agglomerating treatment as described above, at the same time of agglomerating treatment, or before agglomerating treatment, by a hot air dryer, spray dryer, and other conventional dryers. For example, in the drying process, if agglomeration of the toner base particles is allowed to occur, a medium-fluidizing drying machine (for example, commercially available from Nara Kikai Seisakusho K.K. as MSD), a wet surface-modifying machine (for example, commercially available from Nisshin Engineering K.K. as DISPERCOAT), and the like can be opportunely used.

After the agglomerating process and drying process as described above, the obtained toner base particle agglomerate under a dry state undergoes a pulverizing process. It is also possible to adjust the ratio of spherical toner to nonspherical toner by pulverizing methods and conditions setting in this pulverizing process.

When volume-pulverization primarily functions as a pulverizing principle, the nonspherical toner tends to increase. In the case where a jet pulverizing machine is used for pulverizing treatment, the pulverization takes place primarily by volume pulverizing and it becomes possible to produce nonspherical shapes. When a jet pulverizing machine is used, because particles are pulverized by collision with a machine wall or a collision plate, pulverization takes place not only from the joining portion of particles but also pulverizing of particles themselves, producing nonspherical toner. For an example of the specific machine, there is a jet pulverizer (for example, commercially available from Nippon Pneumatic Industries as an I-type mill) which pulverizes agglomerates by impact to the collision plate.

Using a pulverizing machine operating on collision of particles (for example, commercially available from Nippon Pneumatic Industries, PJM-type mill) enables the ratio of spherical toner to be controlled higher than that of the impact type to a collision plate.

In order to control the ratio of the spherical toner to a high level, a mechanical-type pulverizing machine in which surface pulverizing primarily functions as a pulverizing principle is used. When pulverization is carried out by a mechanical pulverizer in this way, a treatment at a lower rotating speed or with greater treatment volume can result in a higher ratio of the spherical toner. The adoption of a closed circuit system pulverizing process also can make the ratio of spherical toner high.

More specifically, for example, when the ratio of spherical toner should be increased, the pulverizing treatment can be carried out by pulverizing particles themselves as well as rotators against stators by allowing particles to pass the shortest clearance of 0.5–10 mm formed by either rotators and rotators or stators and rotators with the particles dispersed in the air stream flowing at a high speed. In this method, materials used in the present invention are not volume-pulverized but primarily pulverized at the surface, enabling the shape to be round. This pulverizing method is explained hereinafter.

In general, a surfactant is used essentially in wet granulation, but the surfactant has a functional group which has a high affinity for water as an originally required function, which poses a problem of chargeability, in particular, environmental stability as a toner. In addition, in the wet granulation method, various contaminating components which have detrimental effects on the chargeability exist in addition to the surfactant, and these components adsorb and pollute the particle surface at the time of wet granulation. In this invention, temporarily agglomerating after granulation and pulverizing by the above method utilizes pealing-operation at the time of pulverizing. Because fresh surfaces other than the particle surfaces formed at the time of wet granulation can be easily formed, thereby achieving charging stability. It is desirable to carry out a full-scale pulverizing treatment (pulverizing is carried out by collision between particles as well as stators and rotators by allowing particles to pass the shortest clearance of 0.5–10 mm formed by rotators and rotators or stators and rotators with particles dispersed in the air stream flowing at a high speed).

The smallest clearance most suited for the pulverizing treatment is related to, for example, the outside diameter of the rotor, and must be set with such equipment configuration taken into account. However, if the smallest clearance is narrower than 0.5 mm, it becomes difficult for particles to pass the clearance under a stable state, resulting in clogging such as agglomeration in the vicinity of the inlet and adhesion of material to stators and/or rotators. If the clearance is greater than 10 mm, a whirling flow required for pulverizing (as well as surface modification) is not thoroughly generated, producing poor collision force between particles and causing lack of uniformity. It becomes difficult to achieve required pulverization and surface modification capabilities.

With respect to a pulverizing temperature, materials are generally pulverized in an air stream at room temperature from 0°–40° C., but the increase of a introduced air temperature enables the toner shape to be controlled to be spherical. Carrying out the multiple pass treatment also can change the toner surface properties (for example, spheroidization). Consequently, when the toner is controlled to be spherical, it is desirable for an introduced air to be heated.

For the retention time in pulverizing treatment, it is desirable for one pass to generally take within scores of seconds, or within a few seconds in view of productivity. The speed of air flow is set from such viewpoint.

For specific mechanical pulverizing equipment which can carry out above-mentioned pulverization, CRIPTRON SYSTEM COSMOS (commercially available from KAWASAKI JUKOGYO K.K.) (in particular, the L type which is designed to improve the efficiency by increasing the rotor and stator lengths can be most suitably applied), or FINE MILL (commercially available from NIPPON PNEUMATIC KOGYO K.K.), TURBO MILL (commercially available from TURBO KOGYO K.K.), COSMOMIZER (commercially available from NARA KIKAI SEISAKUSHO K.K.) and the like are applicable. One example of the above pulverizing equipment is described referring to FIG. 1. In FIG. 1, the rotating section comprises a distributor (3), a multiplicity of rotors (2) with many blades (4) mounted to their circumferences, and partition disks (5) in contact with them, and a casing (6) is mounted with a liner (7) with a large number of grooves inside. When a rotor (2) rotates at a high speed, a violent whirling flow and pressure vibration are generated in the machine. The toner agglomerate is sucked from a feed port together with air, given rotating motion around a rotating shaft (1) at an inlet whirling flow chamber (9), accelerated by a distributor (3), and uniformly distributed to a pulverizing chamber (8). Then, the toner agglomerate is instantaneously pulverized by violent air-whirling flow and the material is discharged from an outlet whirling flow chamber (10) together with air without making a short pass.

It is desirable to use a mechanical pulverizing machine to fix more firmly the added organic or inorganic fine particles and their super fine particles adhered to the toner particle surface with mechanical impact force, while pulverizing the toner agglomerate.

To the surfaces of the toner particles obtained by pulverizing in this way, organic or inorganic fine particles are filmy bonded and the ratio of super fines contained in the toner particles is small.

In addition, the toner particles obtained by pulverization as described above undergo a classification process as required and are air-classified.

The toner finally obtained is adjusted to have an average particle size of 2–10 μm, preferably 3–8 μm. If the average particle size is greater than 10 μm, the toner does not satisfy the requirements for improved quality of duplicated images. The toner whose average particle size is smaller than 2 μm is difficult to manufacture, posing a problem of difficulty in handling at each element of the image forming equipment (toner replenishment, development, transfer, fixation, and cleaning). In the manufacturing method adopted in the present invention, the toner having a distribution containing 50% or more of ±25% average particle size particles, more preferably 60% or more, can be obtained.

The toner composing the developer for developing electrostatic latent images of the present invention is not particularly limited if it contains at least resin for a binder and colorants in the composition of toner particles and has organic or inorganic fine particles adhered to the surfaces as required, and is bonded via a toner agglomeration and pulverizing processes, and can take various compositions in accord with the developing method such as magnetic or nonmagnetic, or charging polarity.

The resin contained in the toner is not particularly limited if it is generally used as a binder in general toners, and examples include thermoplastic resins such as styrene resins, (meta)acrylic resins, olefinic resins, polyester resins, amide resins, carbonate resins, polyethers and polysulfones, or thermosetting resins such as epoxy resins, urea resins and urethane resins, and these copolymers and polymer blends. The binder resin used in the present invention includes those not only in the completely polymeric state, for example, in thermoplastic resins, but also in oligomer or prepolymer state in thermosetting resins, and in addition, includes polymers partly containing prepolymers and crosslinking agents.

Recently, the technique to copy at a further higher speed is required, and in the toner used in such a high-speed system, it is necessary to improve fixation property of toner to transfer paper in a short time and separability from the fixation roller. Consequently, when the toner used in such a high-speed system is planned to obtain, it is desirable to use homopolymer or copolymer synthesized from styrenes, (meta)acrylic-acids, and (meta)acrylates, or polyester resins for binder resin, and for the molecular weight, it is desirable to use binder resins which have a relationship between number average molecular weight (Mn), weight average molecular weight (Mw), and Z average molecular weight (Mz) as $1{,}000 \geqq Mn \geqq 7{,}000$, $40 \geqq Mw/Mn \geqq 70$, $200 \geqq Mz/Mn \geqq 500$, respectively, and in addition, $2000 \geqq Mn \geqq 7000$ for the preferable number average molecular weight (Mn). When the toner is used as an oilless fixation toner, it is desirable for the resin to have 55°–80° C. glass transition temperature and 80°–150° C. softening point and to contain 5–20 weight % gelation component. In order to improve resistance to vinyl-chloride, it is desirable to use polyester resins and in particular desirable to contain 5–20 weight % gelation component.

When light-transmittable color toners used for OHP or full colors are planned to obtain, it is desirable to use polyester resins as binder resin from the viewpoint of resistance to vinyl chloride, light-transmittance as light-transmittable color toners and adhesivity with OHP sheets, and in such event, it is desirable that the resin is linear polyester whose glass transition temperature is 55°–70° C., softening point 80°–150° C., number average molecular weight (Mn) 1,000–15,000 and molecular weight distribution (Mw/Mn) 4 or less. In addition, for a binding resin when a light-transmittable color toner is obtained, linear urethane modified polyester (C) which can be obtained by allowing linear polyester resin (A) to react with diisocyanate (B) is used. The linear urethane-modified polyester referred hereto is the one obtained by reacting 0.3–0.95 mol diisocyanate (B) with 1 mole linear polyester resin which is composed of dicarboxylic acids and diols and has a number average molecular weight of 2,000–15,000 and an acid value of 5 or less with the end group practically comprising the hydroxyl group. A main component of the linear urethane modified polyester (C) has a glass transition temperature of 40°–80° C. and an acid number of 5 or less. Further, linear polyesters may be modified with styrenes, acrylic monomers, aminoacrylic monomers and the like by a graft polymerization, a block polymerization method, and other methods insofar as glass transition temperature, softening point and molecular weight characteristics are similar to the above are ideally used.

The colorants contained in the toner obtained by the manufacturing method of this invention are not particularly limited but various known organic or inorganic pigments and dyes of various colors can be used. In general, it is desirable to use them 1–20 parts by weight, more preferably 2–10 parts by weight on the basis of 100 parts by weight of the above-mentioned binder resin. If the colorant is greater than 20 parts by weight, the toner-fixing properties are lowered. If it is smaller than one part by weight, there is a fear of failure to obtain the desired image density.

This invention can be applied to any type of toner composing developers, and for example, it can be applied to a toner of two-component developers formed by mixing with carriers, or can be applied to a toner of one-component developers.

The developer of the present invention provides excellent blade-cleaning properties, environmental stability and charging stability. In the developing system in which a one-component developer is used and toner thin-layer control is carried out, it has an advantage of easy toner-volume control.

Now referring to embodiments of the present invention, the present invention will be described in detail hereinafter.

(Production Example of Toner A)

| Component | Parts by weight |
|---|---|
| Styrene | 60 |
| n-butylmethacrylate | 35 |
| Methacrylic acid | 5 |
| 2,2-azobis-(2,4-dimethylvaleronitrile) | 0.5 |
| Polypropylene of low molecular weight (commercially available from Sanyo Kasei Kogyo K.K. as BISCOL 605P) | 3 |
| Carbon black (commercially available from Mitsubishi Kasei Kogyo as MA#8) | 8 |

The above materials were mixed by means of a sand stirrer to prepare a polymerizable composite. This polymerizable composite was subjected to polymerization for 6 hours at 60° C. with stirring at a rotating speed of 4,000 rpm using an agitator TK AUTO HOMOMIXER (available from Tokushu Kika Kogyo Co., Ltd.) in a 3% gum arabic aqueous solution. A toner-dispersed solution with spherical particles of average particle size 6 μm was obtained.

Separately, a resin dispersion of methacrylate fluoroalkyl ester and hydrophobic titanium oxide (commercially available from Nippon Aerosil as T-805) were dispersed in advance at a ratio of 5 to 3 by solid weight in water by means of a sand mill (commercially available from Red Devil as paint conditioner).

The mixture of methacrylate fluoroalkyl ester resin/titanium oxide obtained above was added to the toner dispersion solution at a ratio of 0.8 parts by solid content weight to 100 parts by toner solid content weight. Agitation was further continued, and the mixture of methacrylate fluoroalkyl ester resin/titanium oxide was treated to adhere to surfaces of toner particles. Thereafter, after filtration/water rinsing was repeated, this dispersion solution was dried and granulated under conditions of hot air temperature of 80° C., air flow-volume of 10 $m^3$/min, treatment rate of 5 kg/hour, and exhaust gas temperature of 57° C. by means of a dryer (commercially available from Nara Kikai Seisakusyo K.K. as medium-fluidizing dryer MSD-200), and then, a block-form product was obtained by agglomerating and fusing particles with the fine particles existing at interfaces.

The block-form product was pulverized and surface-modified at 18,000 rpm by use of Criptron System (commercially available from Kawasaki Jukogyo K.K. as KTM-XL type) under conditions setting an air-introducing temperature at 10° C. at the inlet, an air-discharge temperature at 28° C., a temperature of treatment section in jacket water-cooling system at 10° C. and a shortest clearance between the stator and the rotator to 5 mm. The obtained particles had an average particle size of 6.2 μm. To 100 parts by weight of the obtained particles, 0.2 parts by weight of hydrophobic silica (commercially available from Wacker K.K. as H-2000) was added and treated in Henschel Mixer (available from Mitsui Miike Kakou K.K.) at 1,500 rpm for 1 minute to give Toner A. The Toner A contained spherical toner particles at 21% by a number rate.

(Production Example of Toner B)

Preparation Method of Fine Particles

Ammonium persulfate (0.4 g) was dissolved in 800 g of ion-exchanged water and transferred to a four-necked flask. While the flask inside was being replaced with nitrogen, the solution was heated to 75° C. A solution containing styrene (160 g) dissolved in 40 g of butyl acrylate was charged and polymerized at an agitation speed of 400 rpm for 6 hours to give a dispersion solution containing uniform particles having a mean particle size of 0.1 μm and a glass transition temperature of 70° C. This dispersion solution was dried with DISPERCOAT (commercially available from Nisshin Engineering K.K.) and pulverized to give Fine Particle "a".

Preparation Method of Toner Particles

One hundred grams of polyester resin (commercially available from Kao K.K. as NE-382) were dissolved in 400 g of mixed solvent of methylene chloride/toluene (8/2). The obtained solution and 5 g of phthalocyanine pigment were placed and dispersed in a ball mill for 3 hours to give a uniform dispersion solution.

Then, this uniform dispersion solution was added into an aqueous solution in which 60 g of 4% solution of methylcellulose (commercially available from Dow Chemical K.K. as METOCELL K35LV) as a dispersion stabilizer, 5 g of a 1% solution of sodium dioctyl sulfosuccinate (commercially available from Nikko Chemical K.K. as NIKKOL OTP75)

and 0.5 g of sodium hexametaphosphate (commercially available from Wako Junyaku K.K.) were dissolved in 1,000 g of ion-exchanged water, using a TK AUTO HOMO-MIXER (commercially available from Tokushu Kika Kogyo K.K.). The rotating speed was adjusted to have an average particle size of 3–10 μm. The mixture was suspended in water to give a toner dispersion system.

Separately, hydrophobic titanium oxide (commercially available from Nippon Aerosil K.K. as T-805) was in advance dispersed in water by means of a sand mill (commercially available from Red Devil K.K. as paint conditioner). The obtained mixture of titanium oxide was added to the toner dispersion system by 0.5 parts by weight of solid content to 100 parts by weight of toner solid content. Agitation was further continued to adhere titanium oxide to toner particle surfaces.

Then, a filtration/water rinsing treatment was repeated to give a block-form particles. This cake-form particles were treated for 5 hours under conditions of 80° C. and 85 RH % by means of a hot air dryer. The particles were agglomerated and melted with titanium oxide existing at interfaces to give a block-form product.

After air-drying the obtained block-form product at 40° C. and 50 RH % for further 5 hours, 100 parts by weight of this block-form product, 8 parts by weight of the Fine Particle "a" and 0.5 parts by weight of negatively charged controlling agent LR-151 (commercially available from Noppon Carlit K.K.) were mixed by means of Henschel Mixer (commercially available from Mitsui Miike Machinery Co., Ltd.) at 3000 rpm for 2 minutes.

This mixture was pulverized/surface-modified at 18,000 rpm by means of Criptron System (commercially available from Kawasaki Jukogyo K.K. as KTM-XL type) under conditions setting an air-introducing temperature at 10° C. at the inlet, an air-discharge temperature at 31° C., a temperature of treatment section in jacket water-cooling system at 10° C., a shortest clearance between the stator and the rotator to 1 mm. The pulverized particles had an average particle size of 6.3 μm.

To 100 parts by weight of the obtained pulverized particles, 0.3 parts by weight of hydrophobic silica (commercially available from Wacker K.K. as H-2000) and 0.5 parts by weight of hydrophobic titanium oxide (commercially available from Nippon Aerosil K.K. as T-805) were added and treated in Henschel Mixer (available from Mitsui Miike Kakoki) at 1,500 rpm for 1 minute to give Toner B. The Toner B contained spherical toner at 15% by a number rate.

(Production Example of Toner C)

In Production Example of Toner A, after wet agglomeration, in place of methacrylate fluoroalkyl ester resin/titanium oxide dispersion and hydrophobic titanium oxide (commercially available from Nippon Aerosil K.K. as T-805), hydrophobic alumina (particles of Aluminum Oxide C commercially available from Nippon Aerosil K.K. and surface-treated with dimethyl silicone) was dispersed in water in advance by means of a sand mill (commercially available from Red Devil K.K. as paint conditioner).

The hydrophobic alumina dispersion solution obtained was added to the toner dispersion system by 0.5 parts by weight of solid content to 100 parts by weight of toner solid content. Agitation was further continued to adhere hydrophobic alumina to toner particle surfaces.

Then, the resultant solution was subjected to a filtration/water rinsing treatment repeatedly. The obtained product was treated for 5 hours under conditions of 80° C. and 85% RH by means of a hot air dryer. The particles were agglomerated and melted with the fine particles existing at interfaces to give a block-form product. This block-form product was air-dried at 40° C. and 50% RH for further 3 hours.

This air-dried product was pulverized/surface-modified at 7,500 rpm by means of Fine Mill (commercially available from Nippon Pneumatic Kogyo K.K. as FM-300S) under conditions setting an air-introducing temperature at 12° C. at the inlet, an air-discharge temperature at 32° C., and a shortest clearance between the stator and the rotator set to 3 mm. The pulverized particles had an average particle size of 6 μm.

To 100 parts by weight of the obtained pulverized particles, 0.2 parts by weight of hydrophobic silica (commercially available from Nippon Aerosil K.K. as R-972) was added and treated in Henschel Mixer (available from Mitsui Miike Kakoki K.K.) at 1,500 rpm for 1 minute to give toner C. The Toner C contained spherical toner at 27% by a number rate.

(Production Example of Toner D)

In Production Example of Toner A, after wet agglomeration, in place of the mixture of methacrylate fluoroalkyl ester resin/titanium oxide, hydrophobic silica (commercially available from Wacker K.K. as H-2000/4) and silane coupling agent (commercially available from Toshiba Silicone K.K. as TSL8311) of 1% by weight to the hydrophobic silica was thoroughly dispersed in methanol.

The obtained dispersion solution containing hydrophobic silica was added to the toner dispersion system at a rate of 0.5 parts by weight of solid content to 100 parts by weight of toner solid content. Agitation was further continued to adhere hydrophobic silica to toner particle surfaces.

Then, a filtration/water rinsing treatment was repeated. The obtained particles were treated for 5 hours under conditions of 80° C. and 85% RH by means of a hot air dryer. The particles were agglomerated and melted with hydrophobic silica existing at interfaces. The particles were further air-dried for 3 hours at 40° C. and 50% RH to give a block-form product.

To 100 parts by weight of the obtained block-form product, 1.5 parts by weight of hydrophobic silica (commercially available from Wacker K.K. as H-2000), and 1.5 parts by weight of Carix Allene compound (commercially available from Orient Kagaku K.K. as E-90) were added and mixed in Henschel Mixer (commercially available from Mitsui Miike Machinery Co., Ltd.) at 3000 rpm for 1 minute.

In addition, this product was pulverized/surface-modified at 6200 rpm by means of a Turbo Mill (commercially available from Turbo Kogyo Company as T-400-RS type) under conditions setting an air-introducing temperature at 12° C. at the inlet, an air-discharge temperature at 30° C., and a shortest clearance between the stator and the rotator set to 2 mm. The pulverized particles of an average particle size of 6.1 μm were obtained.

To 100 parts by weight of the obtained pulverized particles, 0.2 parts by weight of hydrophobic silica were added and treated in Henschel Mixer (available from Mitsui Miike Kakoki K.K.) at 1,500 rpm for 1 minute to give Toner D. The toner D contained spherical toner at 38% by a number rate.

(Production Example of Toner E)

| Component | Parts by weight |
|---|---|
| Styrene | 60 |
| n-butylmethacrylate | 35 |
| Methacrylic acid | 5 |
| 2,2-azobis-(2,4-dimethylvaleronitrile) | 0.5 |
| Polypropylene of low molecular weight (commercially available from Sanyo Kasei Kogyo K.K. as BISCOL 605P) | 3 |
| Carbon black (commercially available from Mitsubishi Kasei Kogyo K.K. as MA#8) | 8 |
| Negative charge-controlling agent chromium complex salt type dye (commercially available from orient Kagaku Kogyo K.K.) as S-34) | 3 |

The above materials were mixed in a sand stirrer to prepare a polymerizable composite. This polymerizable composite was treated for polymerization for 6 hours at 60° C. with stirring at a rotating speed of 4,000 rpm by use of an agitator, TK AUTO HOMOMIXER (available from Tokushu Kika Kogyo K.K.) in a 3% gum arabic aqueous solution. After polymerization reaction, the reaction system was cooled and washed with water three times. The product was filtered and dried and the spherical toner of average particle size 6.2 μm was obtained.

To 100 parts by weight of the spherical toner obtained, 0.2 parts by weight of hydrophobic silica (commercially available from Wacker K.K. as H-2000) was added and treated in Henschel Mixer (available from Mitsui Miike Kakoki K.K.) at 1,500 rpm for 1 minute to give Toner E. The toner E contained spherical toner at 98% by a number rate.

(Production Example of Toner F)

In Production Example of Toner E, after washed with water, treatment was carried out under conditions of 120° C. and 60% RH by use of a hot-air dryer. After preliminarily crushing the product with a feather mill, using a jet pulverizer IDS2 type (commercially available from Nippon Pneumatic Kogyo K.K.), the product was pulverized at a feed rate of 5 kg/hour. Toner F with an average particle size of 6 μm was obtained. The ratio of the spherical toner was 0%.

(Production Example of Toners G, H, I)

(Preparation of Spherical Particle "b")

| Component | Parts by weight |
|---|---|
| Glycidyl methacrylate | 10 |
| Styrene | 60 |
| Butylmethacrylate | 30 |
| Benzoylperoxide | 5 |

The above materials were mixed, agitated and dispersed at high speed in deionized water containing 0.1 weight % of polyvinyl alcohol in a reaction oven equipped with an agitator, an inert gas inlet pipe, a reflux condenser and a thermometer. A homogenous suspension was obtained. This suspension was heated to 80° C. with nitrogen gas blown in, and polymerization was carried out with stirring at the same temperature for 5 hours. Thereafter, water was removed and a polymer with an epoxy group as a reactive group was obtained.

One hundred parts by weight of the polymer with an epoxy group as a reactive group, 40 parts by weight of carbon black MA-100R (commercially available from Mitsubishi Kasei Kogyo K.K.), and 5 parts by weight of polypropylene of low-molecular weight (commercially available from Sanyo Kasei Kogyo K.K. as VISCOL 605P) were mixed, kneaded, and allowed to react at 160° C. by use of a pressure kneader. The obtained mixture was cooled and pulverized. Carbon black graft polymer was obtained.

Then 800 parts by weight of deionized water containing 0.5 wt % sodium dodecylbenzenesulfonate as an anionic surfactant, 80 parts by weight of polymerizable monomer components comprising 80 parts by weight of styrene and 20 parts by weight of n-butyl acrylate, 50 parts by weight of the above carbon black graft polymer, 3 parts by weight of azobisisobutyronitrile and 3 parts by weight of 2,2'-azobisisobutyronitrile were put into the same reaction oven as above. The obtained mixture was mixed and agitated by means of T.K. HOMOMIXER (available from Tokushu Kika Kogyo K.K.) to give a homogeneous suspension.

Then, the suspension was heated to 65° C. with nitrogen gas blowing into the reaction oven. With stirring, suspension polymerization reaction was carried out for 5 hours at this temperature. Temperature was further raised to 75° C. and the polymerization reaction was finished.

Separately a solution in which 2 parts by weight of hydrophobic silica H-2000 (available from Wacker K.K.) and 2 parts by weight of silane coupling agent (commercially available from Toshiba Silicone K.K. as TSL8311) were dispersed in methyl alcohol was prepared.

The obtained dispersion solution was added to and mixed with the suspension solution. The mixture was heated for 1 hour at 80° C. to give a block-form product with particles fused. The obtained block-form product was repeatedly filtered and washed with water and let stand for 5 hours at 60° C. and 80% RH in a hot-air dryer.

The mixture was further dried for 5 hours under conditions of 50° C. and 50% RH. The suspension polymerization agglomerate obtained above was pulverized under the following conditions.

(1) The mixture was pulverized/surface-modified at 18,000 rpm by means of Criptron System (commercially available from Kawasaki Jukogyo K.K. as KTM-XL type) under conditions setting an air-introducing temperature at 3° C. at the inlet, air-discharge temperature at 28° C., a temperature of treatment section in jacket water-cooling at 10° C., a shortest clearance between the stator and the rotator to 5 mm. The pulverized particles had an average particle size of 6.2 μm. A ratio of the spherical toner was 55%.

(2) The mixture was pulverized/surface-modified by Criptron System in a manner similar to the above method (1) except for setting an air-introducing temperature at 20° C. at the inlet and air-discharge temperature at 40° C. The pulverized particles had an average particle size of 6.8 μm. A ratio of the spherical toner was 70%.

(3) The mixture was pulverized/surface-modified by Criptron System in a manner similar to the above method (1) except for setting an air-introducing temperature at 3° C. at the inlet and an air-discharge temperature at 25° C., and a rotation speed to 12,000 rpm. The mixture was further pulverized by a supersonic jet crusher of IDS2 type (commercially available from Nippon Pneumatic Kogyo K.K.). The pulverized particles had an average particle size of 6.0. A ratio of the spherical toner was 20%.

To 100 parts by weight of the particles obtained in the above methods (1), (2) and (3), 0.2 parts by weight of hydrophobic silica (commercially available from Wacker K.K. as H-2000) was added and treated by Henschel Mixer (available from Mitsui Miike Kako K.K.) at 2,000 rpm for 1 minute to give Toners G, H and I.

(Production Example of toner J)

In Production Example of Toner I, in place of 0.2 parts by weight of hydrophobic silica (commercially available from Nippon Aerosil K.K. as R-974), 0.3 parts by weight of the following Fine Resin Particle "c" were added, and treated in Henschel Mixer (available from Mitsui Miike Kako) at 2,000 rpm for 1 minute to give Toner J. A ratio of spherical toner was 28%.

(Production Method of Fine Resin Particle "c")

Ammonium persulfate (0.4 ) was dissolved in 800 g of ion-exchanged water. The solution was placed in a four-necked flask and heated to 75° C. while introducing nitrogen gas. Two hundred grams of methyl methacrylate and 8 g of methacrylic acid were charged into the flask and were treated for polymerization at an agitation speed of 400 rpm for 6 hours. Uniform particles of 0.2 μm were given.

The resultant particles were then repeatedly filtered and rinsed, followed by drying. The agglomerate was pulverized to give Fine Resin Particle "c".

Production of Toner "a"

(Preparation of Nonspherical Fine Powders (a-1))

| Component | Parts by weight |
|---|---|
| Polyester resin (commercially available from Kao K.K. as TAFTON NE-382) | 100 |
| Brilliant carmine 6B (C.I. 15850) | 3 |
| Carix Allene compound (commercially available from Orient Kagaku Kogyo as E-89) | 2 |

The above materials were thoroughly mixed in a ball mill. The mixture was kneaded on 3 rolls heated to 140° C. After the mixture was left to stand to cool, it was coarsely ground by a feather mill. Then, the coarsely ground mixture was further pulverized finely by a jet mill. The finely pulverized particles were air-classified to give Nonspherical Fine Particle (a-1) of average particle size 6 μm.

(Preparation of Spherical Fine Particles (a-2))

One hundred grams of polyester resin (commercially available from Kao K.K. as TAFTON NE-382) was dissolved in 400 g of a mixed solvent of methylene chloride/toluene (8/2 (wt/wt %)). The obtained solution, 3 g of brilliant carmine 6B (C.I. 15820) and 2 g of Carix Allerie compound (commercially available from Orient Kagaku Kogyo K.K. as E-89) were placed in a ball mill and mixed for 3 hours to give a homogeneous dispersion solution.

Then, in an aqueous solution in which 60 g of 4% solution of methyl-cellulose (commercially available from Dow Chemical K.K. as METOCELL K35LV) as a dispersion stabilizer, 5 g of a 1% solution of sodium dioctyl sulfosuccinate (commercially available from Nikko Chemical as NIKKOL OTP75) and 0.5 g of sodium hexametaphosphate (commercially available from Wako Junyaku K.K.) were dissolved in 1,000 g of ion-exchanged water to be suspended, using a TK AUTO HOMOMIXER (commercially available from Tokushu Kika Kogyo K.K.) whose rotating speed was adjusted to give an average particle size of 3–10 μm. After repeating filtration and water-rinsing, by use of a spray drying machine (commercially available from Nisshin Seihun K.K. as DISPACOAT), the suspension was dried to give Spherical Fine Particles (a-2) with average particle size of 6 μm.

Nonspherical Fine Particle (a-1) and Spherical Fine Particle (a-2) were mixed so that a ratio of spherical to nonspherical particles is 50 to 50 in terms of number ratio. To 100 parts by weight of this mixture, 0.2 parts by weight of hydrophobic silica (commercially available from Wacker K.K. as H-2000/4) and 0.5 parts by weight of hydrophobic titanium oxide (commercially available from Nippon Aerosil Company as T-805) were added, mixed and agitated in Henschel Mixer to give Toner "a".

Preparation of Toners b–g (Preparation of Spherical Fine Particle (b-1)

| Component | Parts by weight |
|---|---|
| Styrene | 60 |
| n-butylmethacrylate | 35 |
| Methacrylic acid | 5 |
| 2,2-azobis-(2,4-dimethylvaleronitrile) | 0.5 |
| Polypropylene of low molecular weight (commercially available from Sanyo Kasei Kogyo K.K. as BISCOL 605P) | 3 |
| Carbon black (commercially available from Mitsubishi Kasei Kogyo K.K. as MA#8) | 8 |
| Zinc salicylate complex (commercially available from orient Kagaku K.K. as E-84) | 3 |

The above materials were mixed in a sand stirrer to prepare a polymerizable composite. This polymerizable composite was treated for polymerization for 6 hours at 60° C. with stirring at a rotating speed of 4,000 rpm by an agitator TK AUTO HOMOMIXER (available from Tokushu Kika Kogyo K.K.) in a 3% gum arabic aqueous solution. Spherical particles of average particle size 6 μm were obtained.

After filtration/water rinsing was repeated, the filtrate was thoroughly air-dried at 35° C. and 30% RH to give Spherical Fine Particle (b-1) with average particle size 6 μm.

(Preparation of Nonspherical Fine Particle (b-2))

The above Fine Particle (b-1) was kneaded in a twin-screw extruder heated to 140° C. The kneaded mixture was left to stand to cool. The mixture was coarsely pulverized by a feather mill. The coarsely pulverized mixture was further pulverized finely by means of a jet mill. The finely pulverized mixture was air-classified to give Nonspherical Fine Particle (b-2) with average particle size 6.5 μm.

(Preparation of Toners b to g)

The obtained Spherical Fine Particle (b-1) and Nonspherical Fine Particle (b-2) were mixed at a suitable ratio and post-treated as follows to give the following Toners b–g.

| | Spherical Fine Particle (b-1) | Nonspherical Fine/ Particle (b-2) | (%/%) |
|---|---|---|---|
| Toner b | 8 | 92 | |
| Toner c | 32 | | |
| Toner d | 45 | 55 | |
| Toner e | 78 | 22 | |

In addition to these toners, Spherical Fine Particle (b-1) alone and Nonspherical Fine Particle (b-2) alone were subjected to specified post-treatment to give Toners f and g respectively.

Post-treatment of Toners b–g was carried out by adding 0.2 parts by weight of hydrophobic silica (commercially available from Wacker K.K. as H-2000), mixing and agitating in Henschel Mixer.

With respect to Nonspherical Fine Particle (b-2), because it was unable to hold the desired fluidity by the treatment with 0.2 parts by weight of hydrophobic silica, the particles were treated with 0.5 parts by weight of hydrophobic silica to give Toner "h". Evaluation was carried out in the similar manner for other toners.

Toner "i" for evaluation using the developing equipment which regulates toner thin layer Toner "i" was obtained by carrying out post-treatment of toner d in which 0.5 parts by weight of hydrophobic silica (commercially available from Tokyo Zairyo K.K. as TARANOX-500) was added to the fine particles and the mixture were mixed and agitated with Henschel Mixer.

Manufacturing of toners j, k, and l (Preparation of Spherical Particle (c-1)

| Component | Parts by weight |
|---|---|
| Glycidyl methacrylate | 10 |
| Styrene | 60 |
| Butylmethacrylate | 30 |
| Benzoylperoxide | 5 |

The above materials were mixed, agitated and dispersed at a high speed in deionized water containing 0.1 weight % of polyvinyl alcohol in a reaction oven equipped with an agitator, an inert gas inlet pipe, a reflux condenser, and a thermometer to give a homogenous suspension. This suspension was heated to 80° C. with nitrogen gas blown in, and with stirring at this temperature for 5 hours, polymerization reaction was carried out. Thereafter, water was removed and a polymer with an epoxy group as a reactive group was obtained.

One hundred parts by weight of the polymer with an epoxy group as a reactive group, 40 parts by weight of carbon black MA-100R (commercially available from Mitsubishi Kasei K.K.), and 5 parts by weight of low-molecular weight polypropylene (commercially available from Sanyo Kasei Kogyo K.K. as VISCOL 605P) were mixed, kneaded, and allowed to react at 160° C. by use of a pressure kneader. The obtained mixture was cooled and pulverized. Carbon black graft polymer was obtained.

Then in the reaction oven same as above, 800 parts by weight of deionized water containing 0.5 wt % sodium dodecylbenzenesulfonate as an anionic surfactant, 80 parts by weight of polymerizable monomer components composed of 80 parts by weight of styrene and 20 parts by weight of n-butyl acrylate, 50 parts by weight of the above carbon black graft polymer, 3 parts by weight of azobisisobutyronitrile and 3 parts by weight of 2,2'-azobisisobutyronitrile were placed. The mixture was mixed and stirred by T.K. HOMOMIXER (available from Tokushu Kika Kogyo K.K.) to give a homogeneous suspension.

Then, with nitrogen gas blown into the reaction oven, the suspension was heated to 65° C. With stirring, suspension polymerization reaction was carried out for 5 hours at this temperature. Temperature was further raised to 75° C. and polymerization reactions were finished to give Suspension (i). After the obtained suspension particles were filtered and washed repeatedly, followed by drying, to give Spherical Particle (c-1) of average particle size 6.0 μm.

(Preparation of Nonspherical Particle (c-2))

A solution in which 2 parts by weight of hydrophobic silica H-2000 (available from Wacker K.K.) and 2 parts by weight of silane coupling agent (commercially available from Toshiba Silicone K.K. as TSL8311) were dispersed in methyl alcohol was prepared. To this dispersion, the Suspension (i) was added and mixed. The mixture was heated for 1 hour at 80° C. and a block-form product with particles fused was formed. The obtained block-form product was repeatedly filtered and washed with and left to stand for 5 hours at 60° C. and 80% RH by use of a hot-air dryer. The mixture was further dried for 5 hours under conditions of 50° C. and 50% RH.

The obtained block-form product was further pulverized by a supersonic jet crusher IDS2 type (commercially available from Nippon Pneumatic Kogyo K.K.) and classified to give Nonspherical Particle (c-2) of average particle size 4.7 μm.

(1) Particle (c-1) and particle (c-2) were mixed at a weight ratio of 1 to 1. By adding 0.2 parts by weight of hydrophobic silica (available from Wacker K.K. as H-2000) to 100 parts by weight of the mixture and treating in Henschel Mixer (commercially available from Mitsui Miike Kakoki K.K.) for one minute at 2,000 rpm, Toner "j" was obtained. A ratio of the spherical toner was 45%.

(2) The treatment similar to (1) was carried out on Particle (c-2) alone to give Toner "k". A ratio of the spherical toner was 3%.

(3) Toner "1" was obtained in a manner similar to the manufacturing method of toner "j," with exception of adding 0.3 parts by weight of the Fine Resin Particles "c" in addition to adding 0.2 parts by weight of hydrophobic silica (commercially available from Nippon Aerosil K.K. as R-974) as additives.

Preparation of Toners m, n, o (Preparation of Nonspherical Particles d-1, 2, 3)

In preparation of the above Nonspherical Particle (c-2), by varying pulverizing and air-classifying conditions by use of the supersonic jet crusher IDS2 type (commercially available from Nippon Pneumatic K.K.), Nonspherical Particles with an average particle size of 4.1 μm (d-1), 7.0 μm (d-2) and 8.2 μm (d-3) were obtained.

(1) Particle (c-1) shown in the Toner Preparation Example "j" was mixed with Particles (d-1), (d-2), (d-3) respectively at a weight ratio of 1 to 1. The obtained each mixture (100 parts by weight) was mixed with 0.3 parts by weight of hydrophobic silica (available from Wacker K.K. as H-2000) in Henschel Mixer (commercially available from Mitsui Miike K.K.) for one minute at 2,000 rpm to give Toners m, n and o.

For the carrier to be mixed with these toners for developing electrostatic latent images, three types of Carriers C1–C3 prepared as follows were used.

(Preparation of Carrier C1)

One hundred parts by weight of polyester resin (commercially available from Kao K.K. as NE-1110), 600 parts by weight of inorganic magnetic particles (commercially available from TDK Corp. as MFP-2) and 2 parts by weight of carbon black (commercially available from Mitsubishi Kasei K.K. as MA#8) were thoroughly mixed in Henschel Mixer and pulverized. Then, the pulverized materials were melted and kneaded by use of an extrusion mixer with the cylinder section set to 180° C. and the cylinder head section to 170° C. This mixture was cooled and coarsely pulverized, and further finely pulverized by a jet mill. The finely pulverized particles were classified by an air-classifier and a binder type carrier with average particle size of 55 μm was obtained.

(Preparation of Carrier C2)

Using a rolling fluidized bed (commercially available from Okada Seiko K.K. as SPIRA COTA), surface of ferrite carrier core (commercially available from Powdertech K.K. as F-300) was covered with a thermosetting silicone resin modified with acrylic component. Thus Carrier C2 with an average particle size of 50 μm was obtained.

(Preparation of Carrier C3)

Surface of ferrite carrier core (commercially available from Powdertech K.K. as F-300) was coated with polyethylene by a surface-polymerization-coating method. Thus Carrier C3 with average particle size of 51 μm was obtained.

Measurement of charging amount and low-chargeable toner amount

Figure 2:
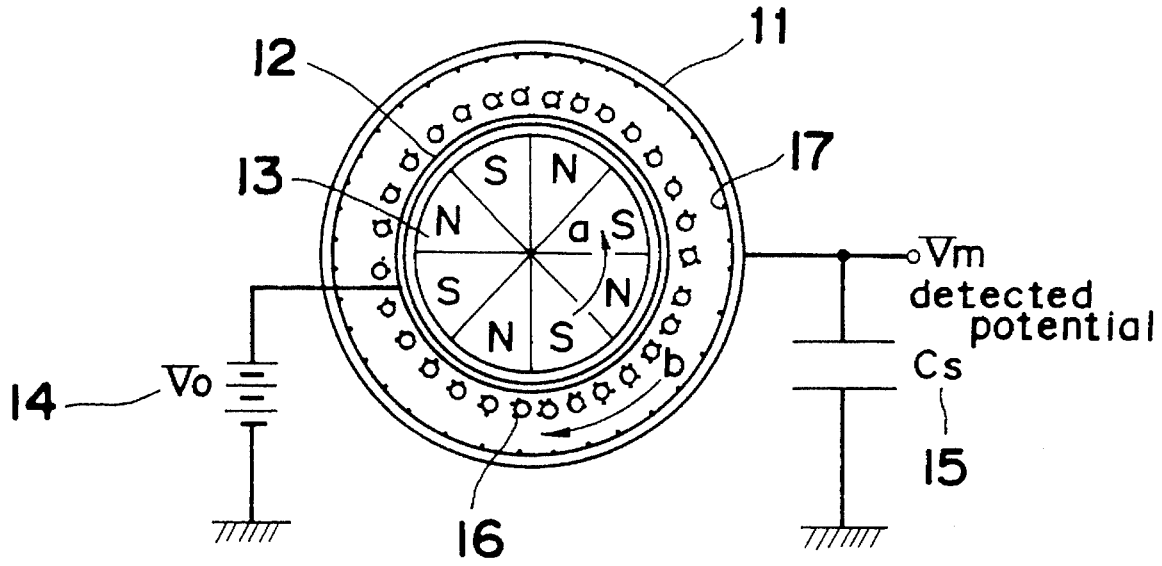
FIG. 2 is a schematic block diagram of a measuring machine of a charge amount of toner.

The charging amount and low-chargeable toner amount were measured under the following conditions using the equipment configured as shown in FIG. 2.

1) Measurement of charging amount

A charging amount of toner was measured by an apparatus shown in FIG. 2. The rotating speed of the magnet roll (13) was set to 1,000 rpm. For the developer, toners and carriers obtained in each preparation examples (toner mixture ratio: 5 wt %) and agitated for 30 minutes were used. One gram of this developer was measured with a precision balance and was placed uniformly on the whole conductive sleeve surface (12). Then, from the bias power supply (14), 3-kV bias voltage was applied at the polarity same as that of the toner. The magnetic roller (13) was rotated for 30 seconds, and the capacitor potential Vm was read when the magnet roll (13) stopped. Then a weight Mi of the separated toner (17) adhering to the cylindrical electrode (11) was measured with the precision balance, and Vm×Cs/Mi (Cs: capacitor capacity) was calculated to determine an average toner charging amount.

2) Measurement of a charging amount of low-chargeable toner

In measuring the charging amount, bias voltage was not applied to the conductive sleeve (12) but grounded and the same measurement was carried out. By measuring how much toner was sent to the cylindrical electrode (11), an amount of the low-chargeable toner was determined and ranked as follows.

o: less than 1.0 wt %

Δ: 1.0–3.0 wt % x: over 3.0 wt %

3) The above measurement was carried out at 25° C. and 55% RH, and after left to stand one night at 30° C. and 85% RH.

Evaluation of Image Developing Capability

A specified toner shown in Table 1 and the above carrier were mixed at a ratio of toner to carrier 5 to 95 to give a 2-component developer. This developer was subjected to various image evaluations shown in Table 1. The developers used in Examples 1, 3 to 7, 10 to 14, and 17 as well as Comparative Examples 1 to 8 were set respectively in a copying machine EP-570Z (commercially available from Minolta Co., Ltd.). The developers used in Examples 2, 9, 15 and 16 were set respectively in a copying machine CF-70 (commercially available from Minolta Co., Ltd.).

1) Fogging on copy images

As described above, in combination with various toners and carriers, image development was performed using the above copier. With respect to fogging on copy images, toner fogging on the images on the white ground was evaluated and ranked. Images without fogging are designated to "o", those with slight fogging but with no practical problem to Δ, and those with visually recognizable fogging and with practical trouble to "x".

2) Copy Images

Images were visually evaluated in terms of thin line reproducibility and gradation reproducibility (number of stages for gray scale reproduction of Eastman Kodak K.K.) and were ranked as follows.

o: Copy images are free from batter or dropout of line images and have 7 or more stages of the number of stages for gray scale reproduction.

Δ: There is slight batter or dropout of line images which does not have any detrimental effects on practical use. The number of stages for gray scale reproduction is 5 to 6 stages.

x: Copy images have batter or dropout of line images resulting in discontinuity and whose number of stages for gray scale reproduction is 4 or less.

3) Evaluation of cleaning properties Using a chart having a 30% B/W ratio, 200 sheets were continuously fed and the failure of toner wipe-out was judged on the image and the results were ranked as follows.

o: Photosensitive member free from failure of toner wipe-out.

Δ: There is a failure of slight toner wipe-out on the photosensitive member which does not appear on copy images.

x: There is a failure of toner wipe-out on the photosensitive member, which appears on copy images as noise.

4) Refilling properties

Using a chart having a 30% B/W ratio, 200 sheets were continuously fed and the change of toner concentration was evaluated and the results were ranked as follows.

o: The change is 0.5 wt % or less and there is no practical problem.

x: The change is greater than 0.5 wt % and causes problems such as lowering of image concentration.

5) Durability test with respect to copy

Using a chart having a 6% B/W ratio, durability test with respect to copy was carried out on 10,000 sheets and copy images and fogging were investigated according to the evaluated standards mentioned above. The results were shown in Table 1.

6) Light transmittance

In Examples 2, 9, 15 and 16, light transmittance tests were also performed. The light transmittance was determined by visually evaluating color brightness in projected images when copy images fixed on an OHP sheet were projected through an OHP projector. The results were shown in Table 1. In Table 1, "o" means that a developer can be used practically from the viewpoint of color reproducibility.

TABLE 1

| Example/ comparison | Toner | Carrier | 25° C. 55% RH Charging amount (μC/g) | 25° C. 55% RH Low chargeability (%) | 30° C. 85% RH Charging amount (μC/g) | 30° C. 85% RH Low chargeability (%) | Cleaning capability | Refilling capability | Initial Fogging | Initial Image | 5000 sheets Fogging | 5000 sheets Image | 10000 sheets Fogging | 10000 sheets Image | Light Transmittance |
|---|---|---|---|---|---|---|---|---|---|---|---|---|---|---|---|
| Example 1 | A | C1 | −32 | o | −30 | o | o | o | o | o | o | o | o | o | — |
| Example 2 | B | C1 | −30 | o | −28 | o | o | o | o | o | o | o | o | o | o |
| Example 3 | C | C3 | −26 | o | −23 | o | o | o | o | o | o | o | o | o | — |
| Example 4 | D | C1 | −30 | o | −29 | o | o | o | o | o | o | o | o | o | — |
| Example 5 | G | C2 | −28 | o | −26 | o | o | o | o | o | o | o | o | o | — |
| Example 6 | H | C2 | −31 | o | −29 | o | o | o | o | o | o | o | o | o | — |
| Example 7 | I | C2 | −26 | o | −25 | o | o | o | o | o | o | o | o | o | — |
| Example 8 | J | C1 | −25 | o | −24 | o | o | o | o | o | o | o | o | o | — |
| Comparison 1 | E | C1 | −33 | o | −18 | x | x | o | Δ | Δ | x | x | x | x | — |
| Comparison 2 | F | C1 | −31 | o | −27 | x | o | x | Δ | Δ | x | x | x | x | — |
| Example 9 | a | C2 | −28 | o | −25 | o | o | o | o | o | o | o | o | o | o |
| Example 10 | b | C1 | −24 | o | −23 | o | o | o | o | o | o | o | o | o | — |
| Example 11 | c | C1 | −25 | o | −23 | o | o | o | o | o | o | o | o | o | — |
| Example 12 | d | C1 | −26 | o | −23 | o | o | o | o | o | o | o | o | o | — |
| Example 13 | e | C1 | −28 | o | −24 | o | o | o | o | o | o | o | o | o | — |
| Example 14 | d | C3 | −23 | o | −20 | o | o | o | o | o | o | o | o | o | — |
| Example 15 | j | C1 | −20 | o | −18 | o | o | o | o | o | o | o | o | o | o |
| Example 16 | l | C2 | −22 | o | −14 | o | o | o | o | o | o | o | o | o | o |
| Example 17 | n | C1 | −18 | o | −17 | o | o | o | o | o | o | o | o | o | — |
| Comparison 3 | f | C1 | −30 | Δ | −21 | x | x | o | Δ | Δ | x | x | x | x | — |
| Comparison 4 | g | C1 | −25 | Δ | −21 | x | o | x | Δ | Δ | x | x | x | x | — |
| Comparison 5 | h | C1 | −28 | o | −18 | x | o | o | Δ | Δ | x | x | x | x | — |
| Comparison 6 | k | C1 | −17 | Δ | −14 | x | o | x | Δ | Δ | x | x | x | x | — |
| Comparison 7 | m | C1 | −25 | x | −20 | x | x | x | Δ | Δ | x | x | x | x | — |
| Comparison 8 | o | C1 | −16 | x | −12 | x | o | x | Δ | Δ | x | x | x | x | — |

Figure 3:
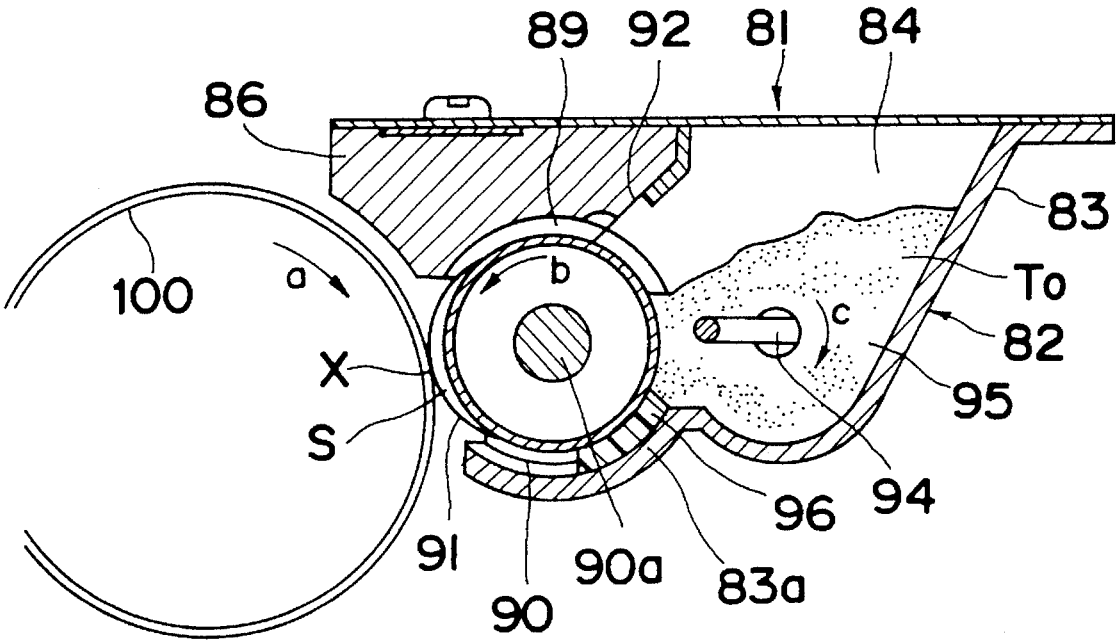
FIG. 3 is a schematic block diagram of a one-component developing machine.

Toners I and i were applied to a one-component developing machine (81) shown in FIG. 3 to evaluate fogging, scattering, and cleaning properties (Examples 18, 19).

First of all, the one-component developing machine (81) will be briefly described.

The one-component system developing device (81) is arranged adjacent to a photosensitive drum (100) which is rotated and driven in the arrow direction (a).

The developing device (81) comprises a developing roller (90) which form rotors, a cylindrical thin-film member (toner supporting member) (91) with slightly longer circumference externally mounted on the developing roller, an elastic pad (89) which presses the thin-film member against the developing roller (90) on both ends of the thin-film member and form a space (s) between the developing roller and the thin-film member, a pressure contact blade (toner regulating member) (92) which is brought in pressure contact with the outer surface of the thin-film member, and a casing (83) which supports and houses these and stores the toner (To).

Downstream a developing range (X), toner flattening pad (96) is arranged. A toner storage tank (95) is formed in the casing (83). In the toner storage tank (95), an agitator (94) rotating in the arrow direction (c) is installed to move the toner stored inside in the arrow direction (c) while preventing the toner blocking.

The above one-component developing machine (81) was set to the following conditions.

Toner supporting member (thin-film member) (91)

A conductive cylindrical member with an inside diameter 0.5 mm longer than the outer shape of the developing roller.

Photosensitive drum (100)

Organic photosensitive conductor (OPC)

Contact pressure with toner supporting member: 0.2 g/mm

Contact width with toner supporting member: 2 mm

Toner regulating member (92)

Plate spring member: Phosphor bronze 0.1 mm thick formed integral with silicon rubber at the tip end. It comes in contact with the toner supporting member at a contact pressure of 4–5 g/mm.

| | |
|---|---|
| • Developing conditions | |
| Surface potential (Vo) | −600 V |
| Development bias ($V_B$) | −250 V |
| Potential at exposed area (Vi) | −80 V |
| • Toner-layer conditions | |
| Charge amount of toner (Q) | −20 to −25 μC/g |
| Toner adhesion amount (M) | ≈0.5 mg/cm$^2$ |

Environment 23° C. 55% RH

Development

The developing machine was mounted to a printer (85 mm/sec) (made by Minolta Co., Ltd). Fogging and scattering conditions around letters were evaluated at the time of an initial copying stage and after $1\times10^4$ times of copy printing. Further, by measuring the particle size distribution on the sleeve, an produced amount of fine particles during the copying process was evaluated.

Evaluation criteria

Fogging o: Copy images are free from batter or dropout of line images and have 7 or more stages of the number of stages for gray scale reproduction.

Δ: There is slight batter or dropout of line images which does not have any detrimental effects on practical use. The number of stages for gray scale reproduction is 5 to 6 stages.

x: Copy images have batter or dropout of line images resulting in discontinuity and whose number of stages for gray scale reproduction is 4 or less.

Scattering o: There is no practical problem when toner-scattering conditions around copied letters are visually observed.

x: Toner-scattering between letters apparently exists in large quantities and clearness of letters is interfered when the scattering states of toner around letters are visually observed.

Cleaning properties o: Photosensitive member free from failure of toner wipe-out.

Δ: There is a failure of slight toner wipe-out on the photosensitive member which does not appear on copy images.

x: There is a failure of toner wipe-out on the photosensitive member, which appears on copy image as noise.

TABLE 2

| | | Initial stage of copying | | | After $1\times10^4$ times of copy | | |
|---|---|---|---|---|---|---|---|
| Example | Toner | Fogging | Scattering | Cleaning properties | Fogging | Scattering | Cleaning properties |
| 18 | I | o | o | o | o | o | o |
| 19 | i | o | o | o | o | o | o |

The developer comprising the toner of this invention provides excellent fluidity, blade cleaning properties, environmental stability, and charge stability. In particular, in the developing system which regulates the thin toner layer using a one-component developer, the toner amount on to the sleeve is easy to control with a blade.

What is claimed is:

1. A developer for developing electrostatic latent images comprising:

a spherical toner containing a binder resin and a colorant whose number average particle size is 2–10 μm, having spherical toner particles of particles size smaller than ½ the number average particle size of the spherical toner being 5% or less by number % and spherical toner particles of particle size more than double the number average particle size of the spherical toner being 1% or less by number %, the spherical toner having a shape factor (SF) of 100–140, and a non-spherical toner having a number average particle size of 2–10 μm, the number average particle size within ±25% of that of the spherical toner, the non-spherical toner having a shape factor (SF) of greater than 140, the spherical toner whose ratio to the total number of toner being 5–80%, and the shape factor (SF) being defined by the following equation:

$$SF=100\pi(\text{maximum length})^2/(4\times\text{area})$$

in which the area is the projected area and the maximum length is the maximum length of a projected image of a particle.

2. The developer for developing electrostatic latent images according to claim 1 wherein the number average particle size of the spherical toner is 3–8 μm.

3. The developer for developing electrostatic latent images according to claim 1 wherein the spherical toner of particle size smaller than ½ the number average particle size of the spherical toner is 3% or less by number % and the spherical toner of particle size more than double the number average particle size is 0.5% or less by number %.

4. The developer for developing electrostatic latent images according to claim 1 wherein the nonspherical toner has the number average particle size within ±20% of that of the spherical toner.

5. The developer for developing electrostatic latent images according to claim 1 wherein the spherical toner and nonspherical toner contain the same binder resin, colorants, and charge regulating agent.

6. The developer for developing electrostatic latent images according to claim 1 wherein the spherical toner and nonspherical toner contain the same binder resin, colorants, and offset-preventing agent.

7. The developer for developing electrostatic latent images according to claim 1 wherein the spherical toner and nonspherical toner contain the same binder resin, colorants, offset-preventing agent, and charge regulating agent.

8. The developer for developing electrostatic latent images according to claim 1 wherein the spherical toner and nonspherical toner contain the same binder resin, colorants, and magnetic powders.

9. The developer for developing electrostatic latent images according to claim 1 wherein the spherical toner and nonspherical toner are formed by the steps comprising:

preparing particles comprising at least a binder resin and a colorant in a wet process, agglomerating the resultant particles, drying the agglomerated particles, and pulverizing the agglomerated particles.

10. The developer for developing electrostatic latent images according to claim 1 wherein the spherical toner is prepared by a suspension method or suspension polymerization method.

11. The developer for developing electrostatic latent images according to claim 1 wherein the spherical toner is prepared by spheroidizing the nonspherical toner by heat treatment.

12. The developer for developing electrostatic latent images according to claim 1 wherein the spherical toner is prepared by spheroidizing the nonspherical toner by mechanical impact force.

13. The developer for developing electrostatic latent images according to claim 1 wherein the nonspherical toner is prepared by the steps comprising:

mixing at least a binder resin with a colorant, melting and kneading the resultant mixture by means of a kneading machine, cooling the kneaded mixture, coarsely pulverizing the cooled mixture, and a finely pulverizing the coarsely pulverized particles by means of a jet pulverizer.

14. A developer for developing electrostatic latent images comprising:

a mixture of spherical toner having spherical toner particles of particles size smaller than ½ the number average particle size of the spherical toner being 5% or less by number % and spherical toner particles of particle size more than double the number average particle size of the spherical toner being 1% or less by number % and having a shape factor (SF) of 100–140 and non-spherical toner having the number average particle size within ±25% of that of the spherical toner and having a shape factor (SF) of higher than 140 prepared by the steps comprising:

forming particles comprising at least a binder resin and a colorant in a wet process, agglomerating particles, drying the agglomerated particles, and pulverizing the agglomerated particles;

the mixture having a weight average particle size of 2–10 μm;

the spherical toner and non-spherical toner comprising the same composition;

the spherical toner whose ratio to the total number of toner being 5–80% and the shape factor (SF) being defined by the following equation:

$$SF=100\pi/\text{maximum length})^2/(4\times\text{area})$$

in which the area is the projected area and the maximum length is the maximum length of a projected image of a particle.

15. The developer for developing electrostatic latent images according to claim 14 wherein the mixture of the spherical toner and non-spherical toner is prepared by the steps comprising:

mixing particles formed in the wet process with fine particles selected from the group consisting of organic fine particles and inorganic fine particles having a particle size of 1/1000–1/10 the average particle size of the particles formed in the wet process, agglomerating the resultant mixture, drying the agglomerated particles, and pulverizing the agglomerated particles.

16. The developer for developing electrostatic latent images according to claim 14 wherein the mixture of the spherical toner and non-spherical toner is prepared by the steps comprising:

agglomerating the particles formed in the wet process, mixing the agglomerated particles with fine particles selected from the group consisting of organic fine particles and inorganic fine particles having a particle size of 1/1000–1/10 the average particle size of the particle formed in the wet process, drying the mixture, and pulverizing the dried mixture.

17. The developer for developing electrostatic latent images according to claim 14 wherein the mixture of the spherical toner and non-spherical toner is prepared by the steps comprising:

agglomerating the particles formed in the wet process, drying the agglomerated particles, mixing the agglomerated particles with fine particles selected from the group consisting of organic fine particles and inorganic fine particles with a particle size of 1/1000–1/10 the average particle size of the particle formed in the wet process, and pulverizing the resultant mixture.

* * * * *